US005783935A

United States Patent [19]

Kyung

[11] Patent Number: 5,783,935

[45] Date of Patent: Jul. 21, 1998

[54] REFERENCE VOLTAGE GENERATOR AND METHOD UTILIZING CLAMPING

[75] Inventor: Kye-hyun Kyung, Anyang, Rep. of Korea

[73] Assignee: Samsung Electronics Co., Ltd., Suwon, Rep. of Korea

[21] Appl. No.: 636,116

[22] Filed: Apr. 22, 1996

[30] Foreign Application Priority Data

Apr. 24, 1995 [KR] Rep. of Korea ..... 1995-9640

[51] Int. Cl.[6] ..... G05F 3/16

[52] U.S. Cl. ..... 323/313; 323/314; 323/907; 327/537

[58] Field of Search ..... 323/907, 313, 323/314, 316, 280; 327/539, 537; 330/297

[56] References Cited

U.S. PATENT DOCUMENTS 4,095,164 6/1978 Ahmed ..... 323/280

4,368,420 1/1983 Kuo ..... 323/303

*Primary Examiner*—Peter S. Wong

*Assistant Examiner*—Shawn Riley

*Attorney, Agent, or Firm*—Marger, Johnson, McCollom & Stolowitz, P.C.

[57] ABSTRACT

A reference voltage generating circuit has a divider circuit for decreasing a received external power-supply voltage and for providing the decreased voltage at a reference voltage output terminal. A PMOS transistor clamps the reference voltage at a predetermined voltage level, one end thereof being coupled to the reference voltage output terminal and the other end being coupled to a ground. A compensating unit adjusts the substrate voltage of the PMOS transistor to compensate for level variations of the reference voltage in response to the level variations. Thus, variations in the reference voltage caused by changes in processing variables are compensated, thereby maintaining the reference voltage at a predetermined level.

36 Claims, 4 Drawing Sheets

REFERENCE VOLTAGE GENERATOR AND METHOD UTILIZING CLAMPING

BACKGROUND OF THE INVENTION

The present invention relates to a method and circuit for generating a reference voltage in a semiconductor device, and more particularly to such a method and circuit for generating a reference voltage of a predetermined level regardless of variations in processing, temperature, and external power-supply voltage.

In view of the reliability and power consumption of a semiconductor device required to continue the trend toward miniaturization and high integration in recent semiconductor manufacturing technology, it is desirable to apply a low voltage to the semiconductor device. In a typical semiconductor device, however, an external circuit operates at 5.0V and an internal circuit operates at 3.3V. To supply a predetermined low voltage to such an internal circuit, a high-capacity semiconductor device incorporates a circuit for generating an internal power supply which uses the 5.0V external supply to generate the 3.3V internal supply.

The internal power-supply circuit is generally comprised of a circuit for generating a reference voltage and a driving circuit. The reference voltage circuit generates a reference voltage for an internal power-supply voltage, and the driving circuit maintains the internal power-supply voltage at a predetermined level on the basis of the reference voltage.

To ensure reliability for a semiconductor device, the internal power-supply circuit should maintain a predetermined voltage level regardless of changes in external power-supply voltage, temperature, and processing. The most dominant factor, however, in determining the voltage level generated by the internal power-supply circuit is the output of the circuit for generating a reference voltage. The circuit for generating a reference voltage is therefore essential for maintaining predetermined voltage level of the the internal power-supply circuit regardless of variations in the other parameters.

However, a PMOS transistor, which is used mainly as a clamp transistor for maintaining a voltage at a predetermined level in a conventional circuit for generating a reference voltage, is susceptible to changes in processing and temperature which affect MOS devices, thus changing its characteristics. It would be desirable to compensate for variations in these characteristics to maintain the reference voltage at a predetermined level.

SUMMARY OF THE INVENTION

One object of the present invention is to provide a method and circuit for generating a reference voltage which generates a reference voltage at a predetermined level regardless of changes in processing and temperature and in the presence of variations in external power-supply voltage.

To achieve the above object, there is provided a circuit for generating a reference voltage comprising: a power-supply divider for decreasing a received external power-supply voltage, and generating the decreased voltage as a reference voltage to a reference voltage output terminal; a PMOS transistor for clamping the reference voltage at a predetermined voltage level, one end thereof being coupled to the reference voltage output terminal and the other end being coupled to a ground; and a compensation circuit for adjusting the substrate voltage of the PMOS transistor to compensate the level variations of the reference voltage in response to the level variations.

In one aspect of the invention, the compensation circuit has a divider for dividing the reference voltage and generating a predetermined divided voltage, and a differential amplifier for differentially amplifying the divided voltage and a gate voltage of the PMOS transistor, and providing the differentially amplified voltage as the substrate voltage of the PMOS transistor.

The present invention also contemplates a method for generating a reference voltage including dividing a power-supply voltage and providing the divided voltage to a reference terminal. The voltage is clamped at the reference voltage terminal with a PMOS transistor and the reference voltage is monitored. The substrate voltage of the PMOS transistor is adjusted in response to the monitored reference voltage.

According to the present invention, changes in the characteristics of a clamp transistor are compensated by adjusting the well voltage of a PMOS transistor used mainly in a circuit for generating a reference voltage in response to the level of the reference or internal reference voltage. That is, when the reference voltage increases due to changes in processing and temperature, the well voltage is decreased, and when the reference voltage lowers, the reference voltage is maintained at a predetermined level by increasing the well voltage.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE PREFERRED EMBODIMENT

The present invention will be described in detail, with reference to the attached drawings.

Figure 1:
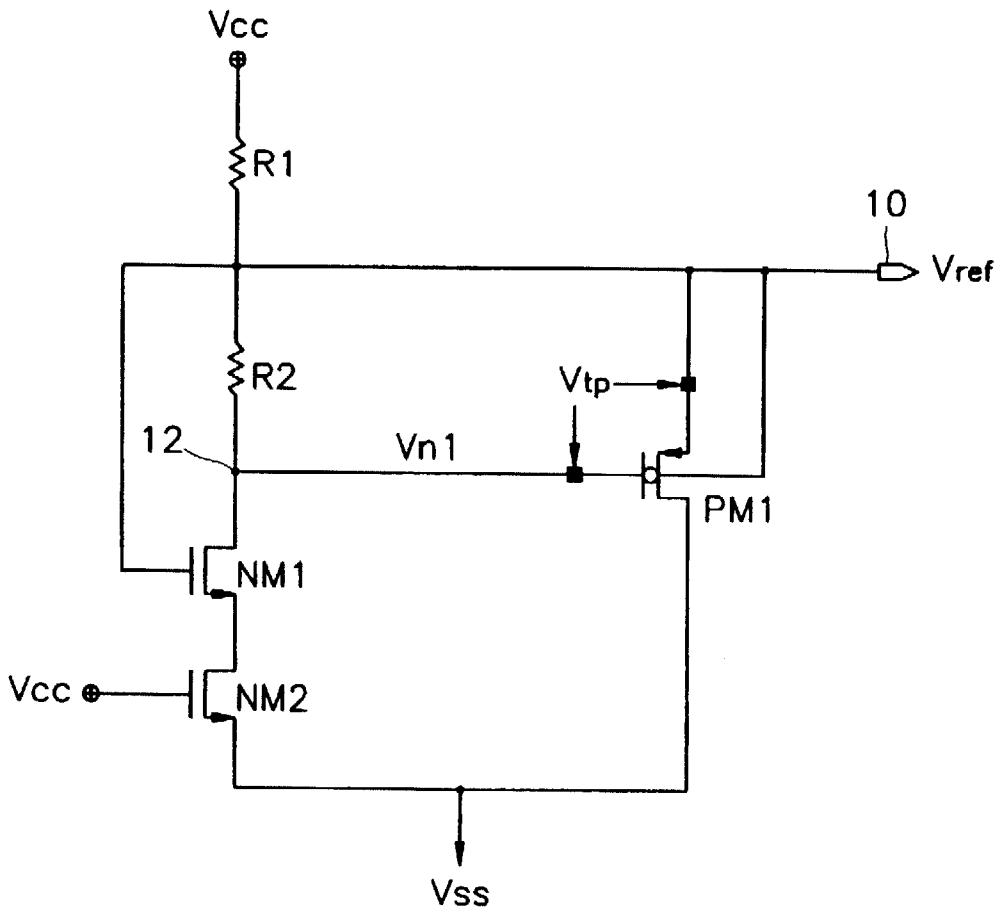
FIG. 1 (PRIOR ART)
FIG. 1 is a circuit diagram of a conventional reference voltage generating circuit.

Prior to the description of the present invention, a conventional circuit for generating a reference voltage is described in detail. FIG. 1 illustrates a conventional circuit for generating a reference voltage incorporating a MOS transistor. In FIG. 1, the circuit is comprised of a resistor R1, one end thereof being coupled to an external voltage source Vcc and the other end being coupled to a reference voltage output terminal 10. A resistor R2 has one end thereof coupled to terminal 10 and the other end coupled to a first node 12. NMOS transistors NM1 and NM2, include channels which are coupled in series between first node 12 and a ground Vss. A PMOS transistor PM1 has a source and a gate which are coupled to both ends of resistor R2, its drain being grounded. As will later be more fully explained, PM1 clamps the voltage across R2. The gate of NM1 is coupled to reference voltage output terminal 10. An external power-supply voltage Vcc is applied to the gate of NM2. A reference voltage Vref is applied to the well of PM1. In FIG. 1, reference voltage Vref is the sum of the threshold voltage Vtp of a PMOS transistor, PM1, and the drain voltage Vn1 of an NMOS transistor, NM1. Thus, reference voltage Vref is expressed as $$\begin{aligned} Vref &= Vtp + Vn1 \\ &= Vtp + (Vtp/R2) \times Rtr \\ &= Vtp(1 + Rtr/R2) \end{aligned} \quad (1)$$

where Rtr indicates the sum of the equivalent resistances of the NMOS transistors.

From equation (1), it is noted that the external voltage Vcc has no impact on the circuit for generating a reference voltage. The impact of temperature variation on the reference voltage is minimized since threshold voltage Vtp is inversely proportional to temperature while the sum Rtr of the equivalent resistances of the transistor is proportional to temperature.

However, changes in threshold voltage Vtp of the PMOS transistor caused by processing changes become an obstacle to maintaining a reference voltage at a predetermined level.

Figure 2:
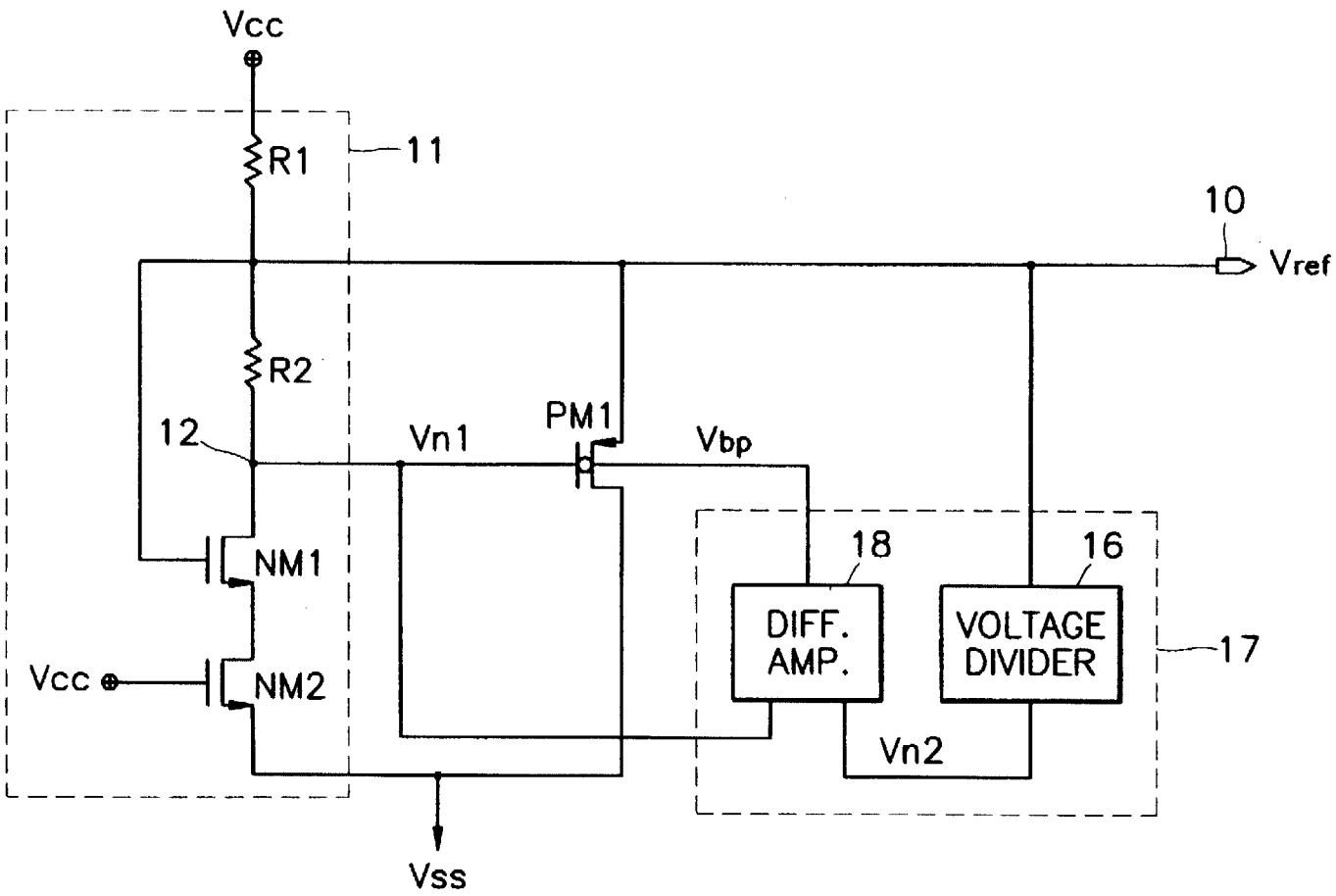
FIG. 2 is a circuit diagram of a circuit for generating a reference voltage according to an embodiment of the present invention.
Figure 3:
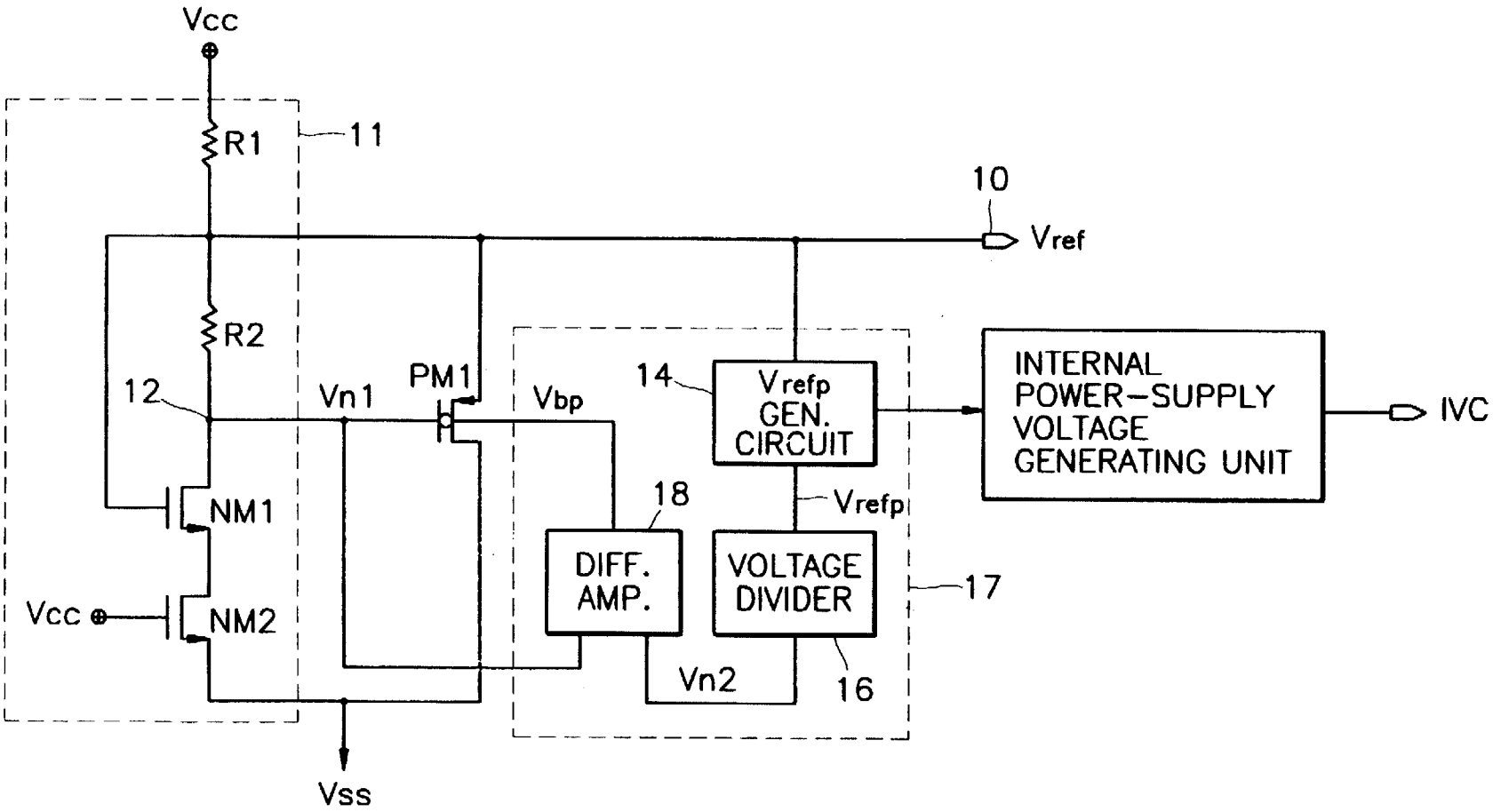
FIG. 3 is a circuit diagram of a circuit for generating a reference voltage according to another embodiment of the present invention.
Figure 4:
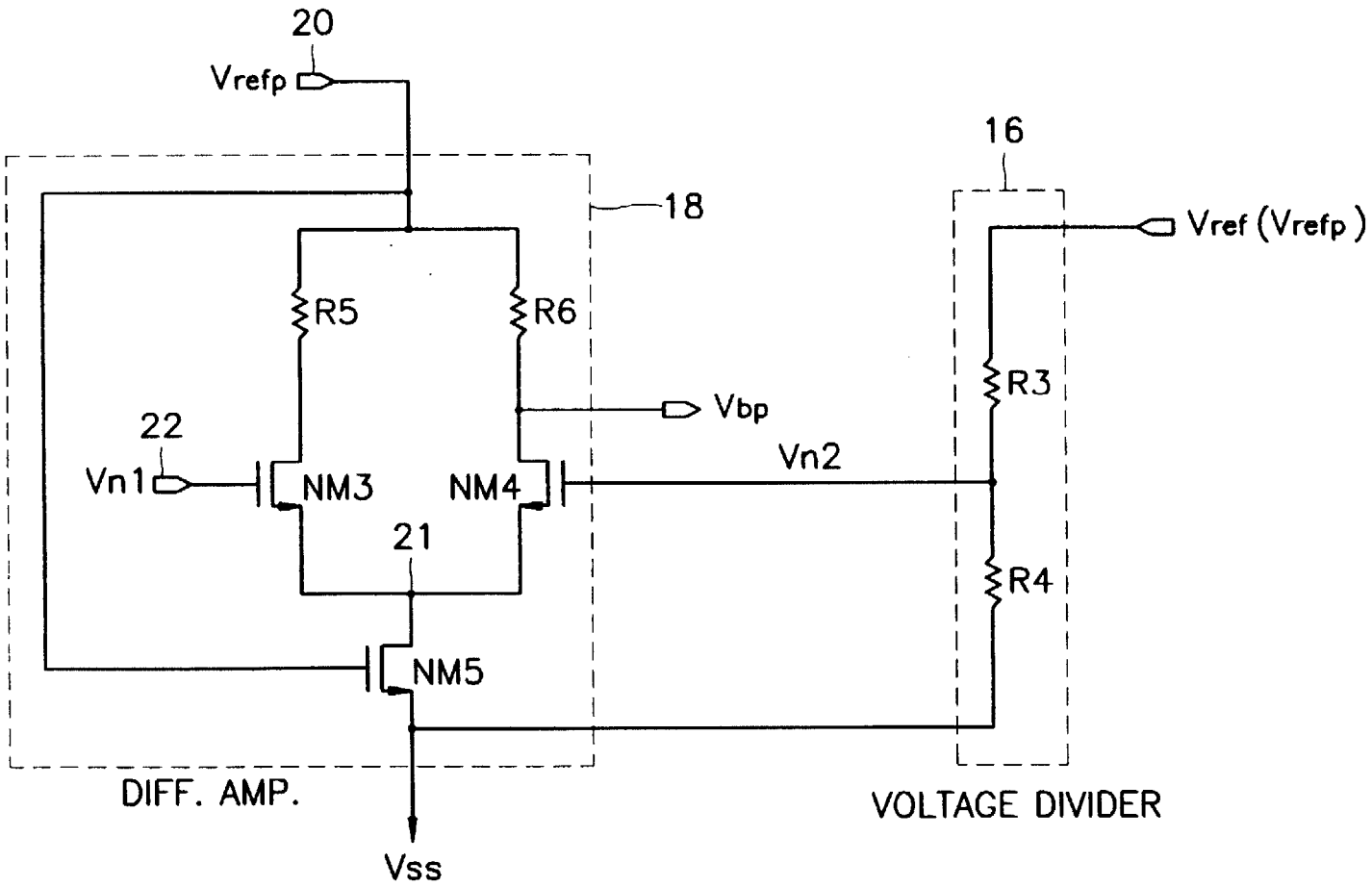
FIG. 4 is a detailed circuit diagram of the voltage divider and the differential amplifier shown in FIGS. 2 and 3.

FIG. 2 is a circuit diagram of a circuit for generating a reference voltage according to an embodiment of the present invention. FIG. 3 is a circuit diagram of a reference voltage generating circuit according to another embodiment of the present invention. FIG. 4 is a detailed circuit diagram of the voltage divider and the differential amplifier shown in FIGS. 2 and 3. Like reference numerals denote the same elements as those of FIG. 1.

In FIG. 2, the circuit includes a dividing unit 11 for reducing a received external power-supply voltage Vcc and generating the reference voltage Vref at the reference voltage output terminal 10. PMOS transistor PM1 has one end coupled to a ground Vss and the other end coupled to reference voltage output terminal 10 for clamping the reference voltage Vref to a predetermined voltage level. A compensating unit 17 adjusts a substrate voltage Vbp of PMOS transistor PM1 to compensate for level variations of reference voltage Vref in response to the level variations of reference voltage Vref. Compensating unit 17 has a divider 16 and a differential amplifier 18. Divider 16 divides reference voltage Vref into a predetermined divided voltage Vn2. Differential amplifier 18 differentially amplifies the divided voltage Vn2 of divider 16 and the gate voltage Vn1 of PMOS transistor PM1 and applies the amplified voltage Vbp to the substrate of PMOS transistor PM1. If the PMOS transistor is formed in a well doped with an N-type impurity, the substrate voltage behaves as a well voltage.

A reference voltage generating circuit of FIG. 3 according to another embodiment of the present invention is the same as that of the above embodiment shown in FIG. 2, except that an internal reference voltage Vrefp generated from an internal reference voltage generator 14 is used in place of reference voltage Vref. Thus, compensating unit 17 in the second embodiment includes divider 16, differential amplifier 18 and internal reference voltage generator 14.

Here, internal reference voltage generator 14 generates internal reference voltage Vrefp responsive to reference voltage Vref. Vrefp is then provided to an internal power-supply voltage generating unit 100, which uses it as a reference level to generate an internal voltage source IVC.

In FIG. 4, divider 16 and differential amplifier 18 of the embodiments of FIGS. 2 and 3 are the same, except that in the embodiment of FIG. 3 reference voltage Vref is replaced with internal reference voltage Vrefp as the input of divider 16.

In FIG. 4, divider 16 includes two resistors R3 and R4 coupled in series between a reference voltage output terminal Vref and a ground Vss, so that divided voltage Vn2 is generated across resistor R4. Differential amplifier 18 has a first NMOS transistor NM3, a second NMOS transistor NM4, a current sync transistor NM5, and an output terminal 24. Here, one end of first NMOS transistor NM3 is coupled through a first drain load R5 to a terminal 20 to which internal reference voltage Vrefp is applied. The other end of transistor NM3 is coupled to a common source node 21 and the gate thereof is coupled to a terminal 22, to which gate voltage Vn1 of PMOS transistor PM1 is applied. One end of second NMOS transistor NM4 is coupled to terminal 22 through a second drain load R6, the other end thereof being coupled to common source node 21 Divided voltage Vn2 is applied to the gate of transistor NM4. The current sync transistor NM5 forms a current path between common source node 21 and ground Vss with internal reference voltage Vrefp being applied to the gate thereof. The drain output of second NMOS transistor NM4 is applied to output terminal 24 which in turn is connected to substrate voltage and well voltage Vbp of PMOS transistor PM1.

The operation and effects of the present invention as constituted above are described as follows.

The circuit of the present invention maintains a reference voltage level by lowering well voltage Vbp when the reference voltage increases due to changes in temperature or in threshold voltage Vtp of PMOS transistor PM1. The reference voltage level is maintained by increasing well voltage Vbp when the reference voltage drops. Here, the well voltage Vbp is generated by the differential amplifier. Gate voltage Vn1 of the PMOS transistor is used as one input of the differential amplifier, and divided voltage Vn2 obtained by dividing reference voltage Vref, or internal reference voltage Vrefp in the embodiment of FIG. 3, in the voltage divider is used as the other input thereof. The voltage divider is provided to maintain the operational voltage Vn2 similar to that of Vref (or Vrefp in FIG. 3).

That is, when threshold voltage Vtp increases as a result of processing change or temperature change, gate voltage Vn1 of PMOS transistor PM1 drops, resulting in increased divided voltage Vn2 and thus a decreased well voltage Vbp provided at the output of the differential amplifier. On the other hand, when threshold voltage Vtp drops due to the processing or temperature change, gate voltage Vn1 of PMOS transistor PM1 increases and divider voltage Vn2 decreases, resulting in increased well voltage Vbp. Therefore, changes in characteristics of a transistor can be compensated by adjusting well voltage Vbp according to the level of the reference voltage or the internal reference voltage.

I claim:

1. A circuit for generating a reference voltage, comprising:

a power-supply voltage divider for decreasing a received external power-supply voltage, and generating said decreased voltage as a reference voltage on a reference voltage output terminal;

a PMOS transistor having a substrate voltage, said PMOS transistor for clamping said reference voltage at a predetermined voltage level, one end thereof being coupled to said reference voltage output terminal and the other end being coupled to a ground wherein said reference voltage is capable of voltage level variations;

a compensation circuit for adjusting said substrate voltage of said PMOS transistor in response to said voltage level variations;

wherein said compensation circuit comprises:

a reference voltage divider for dividing said reference voltage and generating a predetermined divided voltage; and a differential amplifier for differentially amplifying said predetermined divided voltage and a gate voltage of said PMOS transistor, and providing the result as said substrate voltage of said PMOS transistor.

2. A circuit for generating a reference voltage as claimed in claim 1, wherein said differential amplifier comprises:

an internal reference voltage generator used as a reference level for an internal voltage source, said internal voltage generator having said reference voltage applied to an input terminal thereof;

a first NMOS transistor having one end coupled through a first drain load to an output terminal of said internal reference voltage generator, the other end being coupled to a common source node, said PMOS transistor having a gate voltage level applied to a gate of said first NMOS transistor;

a second NMOS transistor having one end coupled through a second drain load to the output terminal of said internal reference voltage generator, the other end being coupled to said common source node, and said divided voltage being applied to a gate of said second NMOS transistor;

a current sync transistor which forms a current path between said common source node and said ground, said internal reference voltage being applied to a gate of said current sync transistor; and an output terminal for providing the drain output of said second NMOS transistor as said substrate voltage of said PMOS transistor.

3. A circuit for generating a reference voltage as claimed in claim 1, wherein said compensation circuit comprises:

an internal reference voltage generator used as a reference level for an internal voltage source, said internal voltage generator having said reference voltage applied to an input terminal thereof;

a divider for dividing said internal reference voltage and generating a predetermined divided voltage; and a differential amplifier for differentially amplifying said predetermined divided voltage and a gate voltage of said PMOS transistor, and providing the result as said substrate voltage of said PMOS transistor.

4. A reference voltage generating circuit as claimed in claim 3, wherein said differential amplifier comprises:

a first NMOS transistor having one end coupled through a first drain load to an output terminal of said internal reference voltage generator, the other end being coupled to a common source node, said PMOS transistor having a gate voltage level applied to a gate of said first NMOS transistor;

a second NMOS transistor having one end coupled through a second drain load to the output terminal of said internal reference voltage generator, the other end being coupled to said common source node, and said predetermined divided voltage being applied to a gate of said second NMOS transistor;

a current sync transistor which forms a current path between said common source node and said ground, said internal reference voltage being applied to a gate of said current sync transistor; and an output terminal for providing the drain output of said second NMOS transistor as said substrate voltage of said PMOS transistor.

5. A method for generating a reference voltage comprising:

dividing a power-supply voltage;

providing the divided voltage to a reference terminal;

clamping the voltage at the reference voltage terminal with a PMOS transistor having a substrate voltage;

monitoring the reference voltage;

adjusting said substrate voltage of the PMOS transistor in response to the monitored reference voltage;

dividing the reference voltage:

differentially amplifying the divided reference voltage and a gate voltage of the PMOS transistor; and applying the differentially amplified voltage to said substrate of the PMOS transistor.

6. The method of claim 5 wherein adjusting the substrate voltage comprises increasing the substrate voltage in response to a drop in the reference voltage.

7. The method of claim 6 wherein adjusting the substrate voltage further comprises decreasing the substate voltage in response to an increase in the reference voltage.

8. The method of claim 5 wherein said method further comprises:

dividing the reference voltage;

using the divided reference voltage to generate a second reference voltage;

differentially amplifying the second reference voltage and the gate voltage of the PMOS transistor; and applying the differentially amplified voltage to the substrate of the PMOS transistor.

9. A circuit for generating a reference voltage comprising:

a first voltage divider having a power supply voltage applied thereto, said voltage divider creating a divided power supply voltage;

a reference terminal having said divided power supply voltage applied thereto;

a PMOS transistor having one end coupled to said reference terminal and the other end coupled to a ground and wherein said PMOS transistor further includes a gate and a substrate;

a second voltage divider operatively connected to said reference terminal, said second voltage divider creating a divided reference voltage; and a differential amplifier having a pair of input terminals and an output terminal, said input terminals being respectively connected to said PMOS gate and to said divided reference voltage and said output terminal being connected to said PMOS substrate.

10. The circuit of claim 9 wherein said circuit further includes an internal reference voltage and wherein said reference terminal is operatively connected to an input terminal of said internal reference voltage and an output terminal of said internal reference voltage is operatively connected to said second voltage divider.

11. The circuit of claim 10 wherein said PMOS substrate has a substrate voltage and said differential amplifier comprises:

a first NMOS transistor having one end coupled through a first drain load to said internal reference voltage output terminal, the other end being coupled to a common source node, and the gate voltage of said PMOS transistor being applied to the gate of said first NMOS transistor;

a second NMOS transistor having one end coupled through a second drain load to said internal reference voltage output terminal, the other end being coupled to said common source node, and said divided reference voltage being applied to the gate of said second NMOS transistor;

a current sync transistor which forms a current path between said common source node and said ground, an output terminal of said internal reference voltage being applied to the gate; and a differential amplifier output terminal for providing the drain output of said second NMOS transistor as the substrate voltage of said PMOS transistor.

12. A circuit for generating a reference voltage, comprising:

a power-supply voltage divider for decreasing a received external power-supply voltage, and generating said decreased voltage as a reference voltage on a reference voltage output terminal;

a PMOS transistor having a substrate voltage, said PMOS transistor for clamping said reference voltage at a predetermined voltage level, one end thereof being coupled to said reference voltage output terminal and the other end being coupled to a ground wherein said reference voltage is capable of voltage level variations; and a compensation circuit for adjusting said substrate voltage of said PMOS transistor in response to said voltage level variations;

wherein said compensation circuit comprises:

an internal reference voltage generator used as a reference level for an internal voltage source, said internal voltage generator having said reference voltage applied to an input terminal thereof;

a divider for dividing said internal reference voltage and generating a predetermined divided voltage; and a differential amplifier for differentially amplifying said predetermined divided voltage and a gate voltage of said PMOS transistor, and providing the result as said substrate voltage of said PMOS transistor.

13. A circuit for generating a reference voltage as claimed in claim 12, wherein said compensation circuit comprises:

a reference voltage divider for dividing said reference voltage and generating a predetermined divided voltage; and a differential amplifier for differentially amplifying said predetermined divided voltage and a gate voltage of said PMOS transistor, and providing the result as said substrate voltage of said PMOS transistor.

14. A circuit for generating a reference voltage as claimed in claim 13, wherein said differential amplifier comprises:

an internal reference voltage generator used as a reference level for an internal voltage source, said internal voltage generator having said reference voltage applied to an input terminal thereof;

a first NMOS transistor having one end coupled through a first drain load to an output terminal of said internal reference voltage generator, the other end being coupled to a common source node, said PMOS transistor having a gate voltage level applied to a gate of said first NMOS transistor;

a second NMOS transistor having one end coupled through a second drain load to the output terminal of said internal reference voltage generator, the other end being coupled to said common source node, and said divided voltage being applied to a gate of said second NMOS transistor;

a current sync transistor which forms a current path between said common source node and said ground, said internal reference voltage being applied to a gate of said current sync transistor; and an output terminal for providing the drain output of said second NMOS transistor as said substrate voltage of said PMOS transistor.

15. A reference voltage generating circuit as claimed in claim 12, wherein said differential amplifier comprises:

a first NMOS transistor having one end coupled through a first drain load to an output terminal of said internal reference voltage generator, the other end being coupled to a common source node, said PMOS transistor having a gate voltage level applied to a gate of said first NMOS transistor;

a second NMOS transistor having one end coupled through a second drain load to the output terminal of said internal reference voltage generator, the other end being coupled to said common source node, and said predetermined divided voltage being applied to a gate of said second NMOS transistor;

a current sync transistor which forms a current path between said common source node and said ground, said internal reference voltage being applied to a gate of said current sync transistor; and an output terminal for providing the drain output of said second NMOS transistor as said substrate voltage of said PMOS transistor.

16. A method for generating a reference voltage comprising:

dividing a power-supply voltage;

providing the divided voltage to a reference terminal;

clamping the voltage at the reference voltage terminal with a PMOS transistor having a substrate voltage;

monitoring the reference voltage;

adjusting said substrate voltage of the PMOS transistor in response to the monitored reference voltage;

dividing the reference voltage;

using the divided reference voltage to generate a second reference voltage;

differentially amplifying the second reference voltage and the gate voltage of the PMOS transistor; and applying the differentially amplified voltage to the substrate of the PMOS transistor.

17. The method of claim 16 wherein adjusting the substrate voltage comprises increasing the substrate voltage in response to a drop in the reference voltage.

18. The method of claim 17 wherein adjusting the substrate voltage further comprises decreasing the substate voltage indifferentially amplified voltage to the substrate of the PMOS transistor.

19. The method of claim 16 wherein said method further comprises:

dividing the reference voltage;

differentially amplifying the divided reference voltage and a gate voltage of the PMOS transistor; and applying the differentially amplified voltage to said substrate of the PMOS transistor.

20. A circuit for generating a reference voltage, comprising:

a power-supply voltage divider for decreasing a received external power-supply voltage, and generating said decreased voltage as a reference voltage on a reference voltage output terminal;

a transistor having a substrate voltage , said transistor for clamping said reference voltage at a predetermined voltage level, one end thereof being coupled to said reference voltage output terminal and the other end being coupled to a ground wherein said reference voltage is capable of voltage level variations;

a compensation circuit for adjusting said substrate voltage of said transistor in response to said voltage level variations; and wherein said compensation circuit comprises:

a reference voltage divider for dividing said reference voltage and generating a predetermined divided voltage; and a differential amplifier for differentially amplifying said predetermined divided voltage and a gate voltage of said transistor, and providing the result as said substrate voltage of said transistor.

21. A circuit for generating a reference voltage as claimed in claim 20, wherein said differential amplifier comprises:

an internal reference voltage generator used as a reference level for an internal voltage source, said internal voltage generator having said reference voltage applied to an input terminal thereof;

a first transistor having one end coupled through a first drain load to an output terminal of said internal reference voltage generator, the other end being coupled to a common source node, said transistor having a gate voltage level applied to a gate of said first transistor;

a second transistor having one end coupled through a second drain load to the output terminal of said internal reference voltage generator, the other end being coupled to said common source node, and said divided voltage being applied to a gate of said second transistor;

a current sync transistor which forms a current path between said common source node and said ground, said internal reference voltage being applied to a gate of said current sync transistor; and an output terminal for providing the drain output of said second transistor as said substrate voltage of said transistor.

22. A circuit for generating a reference voltage as claimed in claim 20, wherein said compensation circuit comprises:

an internal reference voltage generator used as a reference level for an internal voltage source, said internal voltage generator having said reference voltage applied to an input terminal thereof;

a divider for dividing said internal reference voltage and generating a predetermined divided voltage; and a differential amplifier for differentially amplifying said predetermined divided voltage and a gate voltage of said transistor, and providing the result as said substrate voltage of said transistor.

23. A reference voltage generating circuit as claimed in claim 22, wherein said differential amplifier comprises:

a first transistor having one end coupled through a first drain load to an output terminal of said internal reference voltage generator, the other end being coupled to a common source node, said transistor having a gate voltage level applied to a gate of said first transistor;

a second transistor having one end coupled through a second drain load to the output terminal of said internal reference voltage generator, the other end being coupled to said common source node, and said predetermined divided voltage being applied to a gate of said second transistor;

a current sync transistor which forms a current path between said common source node and said ground, said internal reference voltage being applied to a gate of said current sync transistor; and an output terminal for providing the drain output of said second transistor as said substrate voltage of said transistor.

24. A method for generating a reference voltage comprising:

dividing a power-supply voltage;

providing the divided voltage to a reference terminal;

clamping the voltage at the reference voltage terminal with a transistor having a substrate voltage;

monitoring the reference voltage;

adjusting said substrate voltage of the transistor in response to the monitored reference voltage;

dividing the reference voltage;

differentially amplifying the divided reference voltage and a gate voltage of the transistor; and applying the differentially amplified voltage to said substrate of the transistor.

25. The method of claim 24 wherein said method further comprises:

dividing the reference voltage;

using the divided reference voltage to generate a second reference voltage;

differentially amplifying the second reference voltage and the gate voltage of the transistor; and applying the differentially amplified voltage to the substrate of the transistor.

26. A circuit for generating a reference voltage comprising:

a first voltage divider having a power supply voltage applied thereto, said voltage divider creating a divided power supply voltage;

a reference terminal having said divided power supply voltage applied thereto;

a transistor having one end coupled to said reference terminal and the other end coupled to a ground and wherein said transistor further includes a gate and a substrate;

a second voltage divider operatively connected to said reference terminal, said second voltage divider creating a divided reference voltage; and a differential amplifier having a pair of input terminals and an output terminal, said input terminals being respectively connected to said gate and to said divided reference voltage and said output terminal being connected to said substrate.

27. The circuit of claim 26 wherein said circuit further includes an internal reference voltage and wherein said reference terminal is operatively connected to an input terminal of said internal reference voltage and an output terminal of said internal reference voltage is operatively connected to said second voltage divider.

28. The circuit of claim 27 wherein said substrate has a substrate voltage and said differential amplifier comprises:

a first transistor having one end coupled through a first drain load to said internal reference voltage output terminal, the other end being coupled to a common source node, and the gate voltage of said transistor being applied to the gate of said first transistor;

a second transistor having one end coupled through a second drain load to said internal reference voltage output terminal, the other end being coupled to said common source node, and said divided reference voltage being applied to the gate of said second transistor;

a current sync transistor which forms a current path between said common source node and said ground, an output terminal of said internal reference voltage being applied to the gate; and a differential amplifier output terminal for providing the drain output of said second transistor as the substrate voltage of said transistor.

29. A circuit for generating a reference voltage, comprising:

a power-supply voltage divider for decreasing a received external power-supply voltage, and generating said decreased voltage as a reference voltage on a reference voltage output terminal;

a transistor having a substrate voltage, said transistor for clamping said reference voltage at a predetermined voltage level, one end thereof being coupled to said reference voltage output terminal and the other end being coupled to a ground wherein said reference voltage is capable of voltage level variations; and a compensation circuit for adjusting said substrate voltage of said transistor in response to said voltage level variations;

wherein said compensation circuit comprises:

an internal reference voltage generator used as a reference level for an internal voltage source, said internal voltage generator having said reference voltage applied to an input terminal thereof;

a divider for dividing said internal reference voltage and generating a predetermined divided voltage; and a differential amplifier for differentially amplifying said predetermined divided voltage and a gate voltage of said transistor, and providing the result as said substrate voltage of said transistor.

30. A circuit for generating a reference voltage as claimed in claim 29, wherein said compensation circuit comprises:

a reference voltage divider for dividing said reference voltage and generating a predetermined divided voltage; and a differential amplifier for differentially amplifying said predetermined divided voltage and a gate voltage of said transistor, and providing the result as said substrate voltage of said transistor.

31. A circuit for generating a reference voltage as claimed in claim 30, wherein said differential amplifier comprises:

an internal reference voltage generator used as a reference level for an internal voltage source, said internal voltage generator having said reference voltage applied to an input terminal thereof;

a first transistor having one end coupled through a first drain load to an output terminal of said internal reference voltage generator, the other end being coupled to a common source node, said transistor having a gate voltage level applied to a gate of said first transistor;

a second transistor having one end coupled through a second drain load to the output terminal of said internal reference voltage generator, the other end being coupled to said common source node, and said divided voltage being applied to a gate of said second transistor;

a current sync transistor which forms a current path between said common source node and said ground, said internal reference voltage being applied to a gate of said current sync transistor; and an output terminal for providing the drain output of said second transistor as said substrate voltage of said transistor.

32. A reference voltage generating circuit as claimed in claim 29, wherein said differential amplifier comprises:

a first transistor having one end coupled through a first drain load to an output terminal of said internal reference voltage generator, the other end being coupled to a common source node, said transistor having a gate voltage level applied to a gate of said first transistor;

a second transistor having one end coupled through a second drain load to the output terminal of said internal reference voltage generator, the other end being coupled to said common source node, and said predetermined divided voltage being applied to a gate of said second transistor;

a current sync transistor which forms a current path between said common source node and said ground, said internal reference voltage being applied to a gate of said current sync transistor; and an output terminal for providing the drain output of said second transistor as said substrate voltage of said transistor.

33. A method for generating a reference voltage comprising:

dividing a power-supply voltage;

providing the divided voltage to a reference terminal;

clamping the voltage at the reference voltage terminal with a transistor having a substrate voltage;

monitoring the reference voltage;

adjusting said substrate voltage of the transistor in response to the monitored reference voltage;

dividing the reference voltage;

using the divided reference voltage to generate a second reference voltage;

differentially amplifying the second reference voltage and the gate voltage of the transistor; and applying the differentially amplified voltage to the substrate of the transistor.

34. The method of claim 33 wherein adjusting the substrate voltage comprises increasing the substrate voltage in response to a drop in the reference voltage.

35. The method of claim 34 wherein adjusting the substrate voltage further comprises decreasing the substate voltage indifferentially amplified voltage to the substrate of the transistor.

36. The method of claim 33 wherein said method further comprises:

dividing the reference voltage;

differentially amplifying the divided reference voltage and a gate voltage of the transistor; and applying the differentially amplified voltage to said substrate of the transistor.

* * * * *